US005956811A

United States Patent [19]

Cahannes et al.

[11] Patent Number: 5,956,811

[45] Date of Patent: Sep. 28, 1999

[54] REVOLVING FLAT CARD

[75] Inventors: Paul Cahannes, Embrach; Oliver Wuest, Seuzach, both of Switzerland

[73] Assignee: Rieter Machine Works, Ltd., Winterthur, Switzerland

[21] Appl. No.: 08/682,079

[22] Filed: Jul. 15, 1996

[30] Foreign Application Priority Data

Jul. 14, 1995 [CH] Switzerland ..... 2082/95

[51] Int. Cl.[6] ..... D01G 15/08; D01G 15/28

[52] U.S. Cl. ..... 19/102; 19/111; 474/205

[58] Field of Search ..... 19/98, 102, 103, 19/111, 113, 114; 474/202, 204, 205–249, 201

[56] References Cited

U.S. PATENT DOCUMENTS

| | | | |
|---|---|---|---|
| 2,627,756 | 2/1953 | Bendall | 474/204 |
| 4,741,432 | 5/1988 | Dekko | 474/204 |
| 4,827,573 | 5/1989 | Kuehl | 19/102 |
| 4,955,111 | 9/1990 | Jagst | 19/102 |
| 5,473,795 | 12/1995 | Spix et al. | 19/113 |
| 5,542,154 | 8/1996 | Demuth et al. | 19/114 |

FOREIGN PATENT DOCUMENTS

| | | |
|---|---|---|
| 0567747 | 11/1993 | European Pat. Off. . |
| 0627507 | 12/1994 | European Pat. Off. . |
| 3835776 | 4/1990 | Germany . |
| 9313633 U | 12/1993 | Germany . |

*Primary Examiner*—Michael A. Neas

*Attorney, Agent, or Firm*—McAulay Nissen Goldberg Kiel & Hand LLP

[57] ABSTRACT

In some embodiments, the drive belt for receiving the flats in a revolving flat card employs pairs of connecting elements for snap-fitting into an aperture in an end head at one end of a flat. Each connecting element has an inclined surface which extends from the body of the belt to form an acute angle of from 60° to 80°. The end head of each flat has a rectangular opening to receive the pair of connecting elements and has transverse molding each provided with an inclined surface to mate with the inclined surfaces of the connecting elements of the belt. In another embodiment, the drive belt employs pairs of ribs of simple rectangular section to engage within a buckle element of a flat while each rib is able to flex about a root of the rib at the belt body.

43 Claims, 8 Drawing Sheets

REVOLVING FLAT CARD

This invention relates to a revolving flat card. More particularly, this invention relates to a connection between a flat and a flexible drive belt in a flat arrangement of a revolving flat card.

As is known, for example for European Patent Application 0 627 507, revolving flat cards have been constructed with individual flats connected to an endless belt wherein the belt has fixing elements provided in pairs to secure a flat to the belt. Each element is provided with a connecting part formed as an integral part of an elongated belt body and a foot part separated from the belt body. In this arrangement, each foot part acts as a holder for a corresponding counterpart provided on the flat. In a preferred embodiment, each pair of fixing elements forms a snap-on connection acting on counterparts on the flat.

It is the goal of the present invention to propose solutions in which in a connection of the type mentioned contradicting goals can be achieved, namely that, on the one hand, the flat remains firmly fixed in a predetermined position on the drive belt during operation of the revolving flat arrangement and that, on the other hand, the flat can be removed and re-connected to the belt if needed (e.g. for maintenance purposes).

It is another object of the invention to eliminate any need for mechanical guides for the flats mounted on an endless belt in a card.

Briefly, the invention provides a drive belt for mounting a plurality of flats in a revolving flat card. In this respect, the drive belt is comprised of a body having a plurality of teeth integral with and disposed on one side as well as a plurality of pairs of connecting elements integral with and disposed on an opposite side from the teeth. In accordance with the invention, each connecting element is of a predetermined height relative to the body and has an inclined surface on one side extending from the body and forming a predetermined acute angle with the body. The inclined surfaces of the connecting elements of each pair of connecting elements are directed in opposite directions longitudinally of the body. In addition, each connecting element is spaced from the other connecting element of a respective pair of connecting elements to permit flexing of the connecting elements towards each other in order to effect a snap-on connection with an opening of a clamp element of a flat.

In accordance with the invention, the inclined surface of the connecting element with the body forms an acute angle in a range of from 60° to 80°. In addition, the connecting elements of each pair of connecting elements are spaced apart to define a slot of a width of at least one millimeter.

The invention further provides at least one flat which is removably mounted on the drive belt wherein the flat has a head at least one end which includes an element defining an opening which receives a respective pair of the connecting elements of the belt in mating relation. In one embodiment, the head of the flat includes a pair of spaced apart parallel moldings each of which has an inclined surface mating with an inclined surface of a respective connecting element in order to form a snap-fit connection of the flat on the belt. Typically, the snap-on connection generates a holding force exceeding one-half of the weight of the flat which, in turn, is in the range of from 15 Newtons (N) to 40 Newtons (N).

Still in accordance with the invention, a guide rail may be positioned for guiding the flats longitudinally thereof during revolving of the belt in an endless path. In such an embodiment, a fitting station may be provided adjacent one end of the guide rail in order to define a space of a size sufficient to pass a flat therethrough into or from engagement with the belt while deflecting the belt in a direction away from the guide rail.

The advantages of the present invention are seen in particular in that no additional mechanical guides are required for flat deflection and that a simple and practical connection is ensured for the flats on the drive belt during operation. The flats can easily be taken off the drive belt and can be exchanged. The inventive solution is applicable not merely to the known flats provided with block-shaped heads, but e.g. also to flats provided with rod-shaped sliding pins, e.g. according to EP-A-567747.

Each flat comprises a clothing support element which is to be connected to the drive belt. The flat can comprise heads at its ends which are to be connected to the clothing support element as well as to the drive belt.

The invention is applicable in any case with a flat the clothing support element of which is formed a sa hollow profile provided with end heads which are formed separately and connected to the hollow profile. A flat of such type is described eg. in U.S. Pat. No. 4,8287,573 and there consists of a steel tube drawn through a profiling template. At both ends of the flat, a solid end head each is provided for the connection to a drive belt. These head ends are connected to the flat by either welding, rivets or bolts in such a manner that they can be replaced if they are worn out. A preferred solution of the latter problem is shown in EP-A-627 507 (FIGS. 8 through 11) and is applicable in the context of the present invention also. In particular, this type of connection is advantageous if the flats are made from hollow profiles of light metal such as aluminum or similar metals.

These and other objects and advantages of the invention will become more apparent from the following detailed description taken in conjunction with the accompanying drawings wherein.

Figure 1:
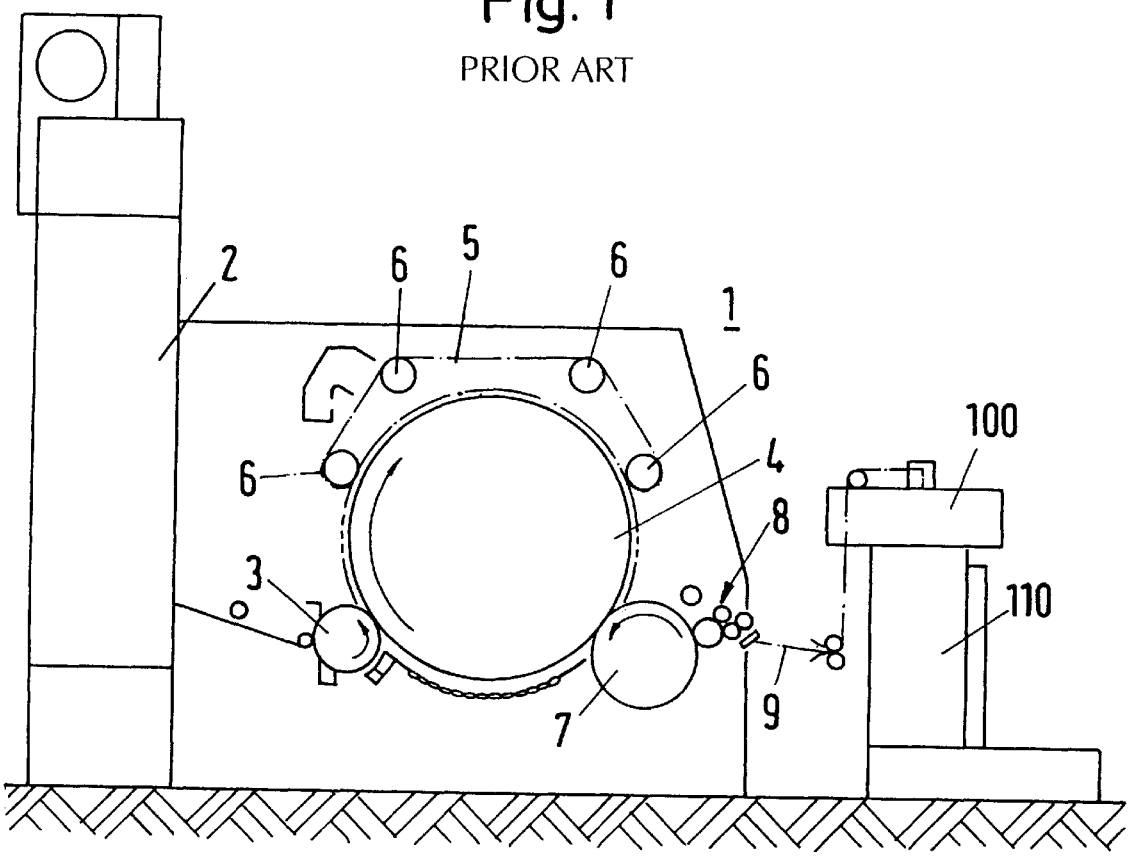
Fig. 1 PRIOR ART
FIG. 1 illustrates a schematic side view of a revolving flat card as described in EP-A-627 507.

In FIG. 1, a revolving flat card 1 known as such is shown, e.g. a card model C 50 of Maschinenfabrik Rieter AG, Switzerland. In use, the fiber material in the form of opened and cleaned fiber flocks is fed to a feed chute 2 and taken in by a breaker roll (or take-in roll) 3 as a fiber layer, then is transferred to a main carding cylinder 4 (or drum) and parallelized by a set of revolving flats 5 which, driven around deflecting rolls 6, moves in the same direction or in the opposite direction of the rotation of the cylinder 4. Fibers from the fiber web on the cylinder 4 thereupon are taken over by a takeoff roll 7 and in a web supply arrangement 8 consisting of several rolls are arranged in the form of a card sliver 9. This card sliver 9 then is deposited into a transporting can 110 in cyclic layers by a sliver deposition device 100.

Figure 2:
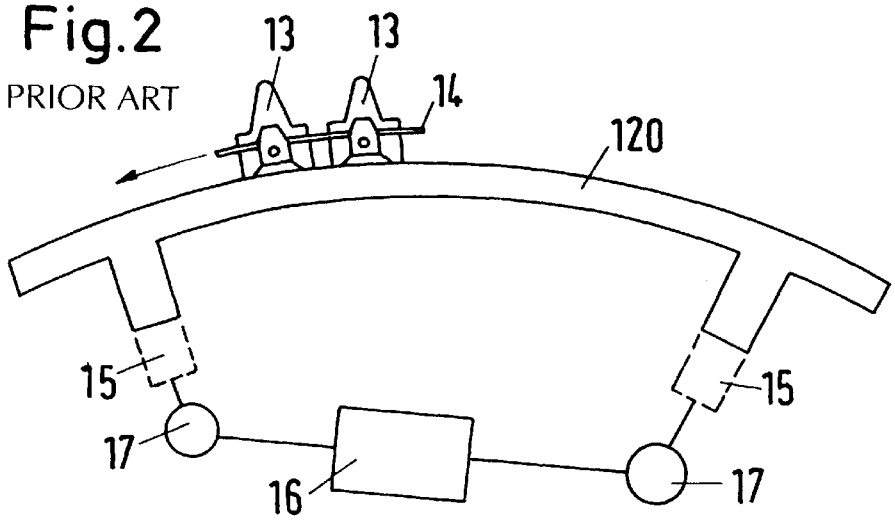
Fig.2 PRIOR ART
FIG. 2 illustrates a schematic view of a portion of a revolving flat arrangement of a card according to FIG. 1.

In FIG. 2, a flexible arch 120 of a card of this type is shown partially with revolving flats 13 (two of them merely being shown) slowly moving thereon and driven by a toothed (or power grip) belt 14 and a drive mechanism (not shown) in the direction of the cylinder rotation or in the opposite direction. On this flexible arch 120, setting elements 15 are provided permitting the setting of the clearance between the revolving flats 13 and the carding cylinder surface, the so called carding clearance. The design of a setting element of such type on the flexible arch is known, e.g. from the German utility model DE-U-93 13 633.1. In that case, the setting elements 15 can be set not just manually but also automatically by activators such as e.g. small setting motors 17. Details of this system are described in U.S. Pat. No. 5,625,924, issued May 6, 1997 and thus are not repeated here.

Figure 3:
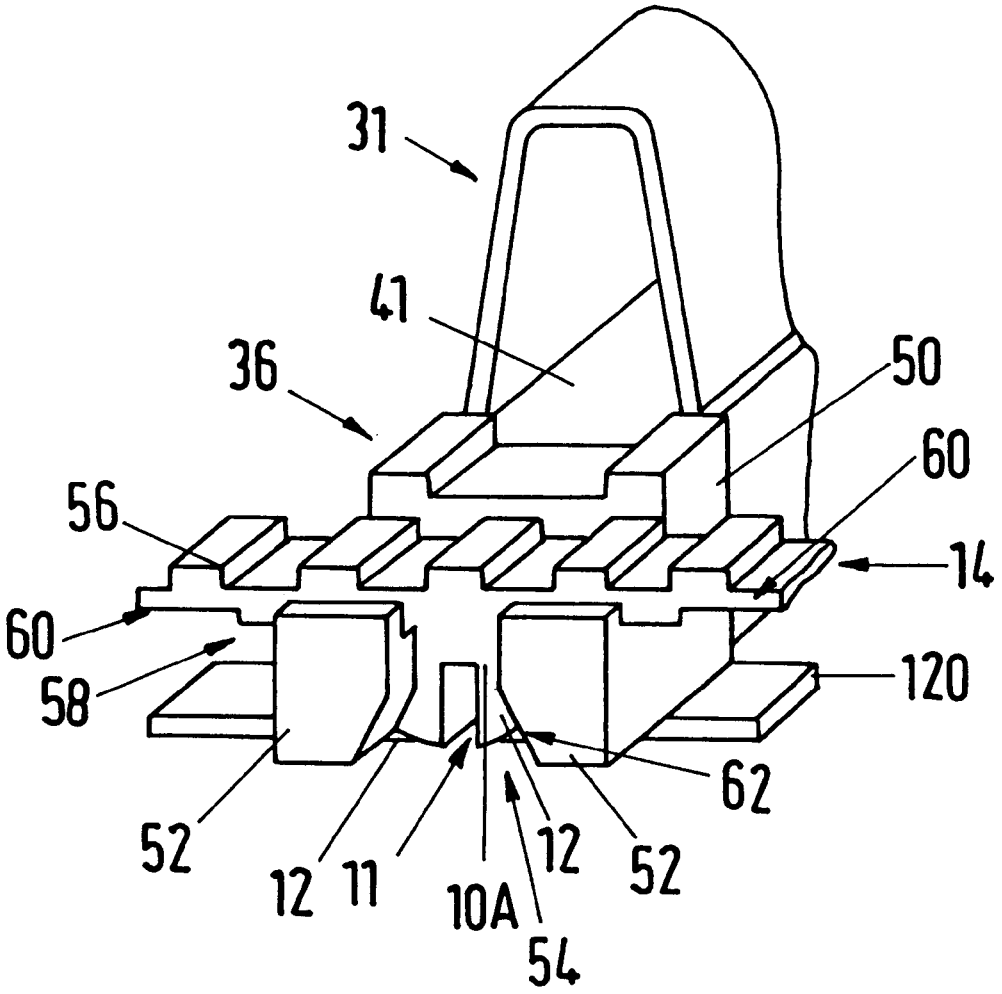
Fig. 3 PRIOR ART
FIG. 3 illustrates an axonometric view of a flat connected to a drive belt as in FIG. 12 of EP-A-627 507.

A set of revolving flats according to DE-A-38 35 776 comprises, e.g. 106 flats, 41 of which are in working position i.e. in contact with the gliding guide. In FIG. 3, the preferred embodiment according to EP-A-627 507 is shown of the connection of a flat 31 to a drive (toothed) belt 14. An end head 36 of the flat 31 comprises an insert 41 and a glide member 50. The insert 41 extends into a take-up portion of a hollow profile and is fixed therein. Fixation has been explained with reference to the FIGS. 8 through 11 in EP-A-627 507 and thus is not repeated herein.

The glide member 50 is guided along the flexible arch 120 while the flat 31 is in the working position and along a rail (not shown) while on a return path. The glide member 50 is provided with two extensions 52 which together form a take-up opening 54.

The drive belt 14 is designed as a toothed belt or power grip belt. The teeth on the belt "inside surface" 56 (i.e. the surface facing the inside relative to the closed circulation loop) engage the drive gears (not shown). Recesses 60 are provided in pairs on the "outside surface" 58 of the belt 14 which faces the flexible arch 120 while the flats 31 are in their working position. Each recess 60 receives an extension 52. The belt is provided with a protrusion 10A between each pair of recesses 60 which forms an integral part of the belt. The protrusion 10A is taken up in the take-up opening 54 between the extensions 52. The protrusion 10A is provided with a slot 11 and thus forms two "legs" each of which is provided in its foot portion with a cam 12. Each extension 52 has an inclined surface 62 permitting better take-up and holding of the cams 12 by the two extensions 52. The legs can be elastically pressed together in such a manner that they form a snap-on connection with the end head 36 of the flat 31.

The connection established between the protrusion 10A and the extensions 52, on the one hand, is sufficiently strong to hold the flat on the belt (even when the flat is no longer is guided by the arch 120) and to transmit the drive forces and, on the other hand, can be released (manually) by an operator without using special tools. Since no additional (separate) elements are required, manufacturing cost can be kept low and mounting and dismantling can be effected efficiently. The combination of materials in the glide member of the flat and in the glide guide element of the arch can be adapted and optimized, whereas the flat body on which the card clothing is fixed still can be manufactured cost-efficiently and strength and weight of this element can be chosen optimally.

In designing the card flat described above, steel or light metals such as aluminum are advantageously chosen. The flat 31, the profiled shape of which is shown in FIG. 3, is drawn if made from a steel tube or is extruded via a suitably profiled template (so called extrusion molding) if aluminum is used. If steel or aluminum are used, a cold forming processing is applied in manufacturing the flats. The end head 36 preferentially is made from cast iron or from sintered metal, but can also be made from any other solid metal. Care is to be taken however, that the lower side of the head is to be sufficiently hard as to resist undue and premature wear.

In accordance with the invention, an endless belt 200 is provided with a plurality of repeating sections only one of which need be described. The belt 200 comprises a continuous elongated body 202 extending in the longitudinal direction, pairs 204, 206 of connecting elements 208, 210 and teeth 212. The belt is case in one piece of a material into which longitudinally extending reinforcements (e.g. filaments or wires, not shown) can be incorporated during casting. The (matrix) material preferentially is an elastomer, e.g. polyurethane, such that the body 202 is elastically deformable.

The body 202 is of predetermined width B (e.g. ranging from 20 to 30 millimeters) and of predetermined thickness D (e.g. ranging from 1 to 3 millimeters). The thickness D can be chosen as a function of the tensile forces to be transmitted, e.g. as a function of the number of flats. The length of the belt body 202 is explained in more detail in the following.

Figure 5:
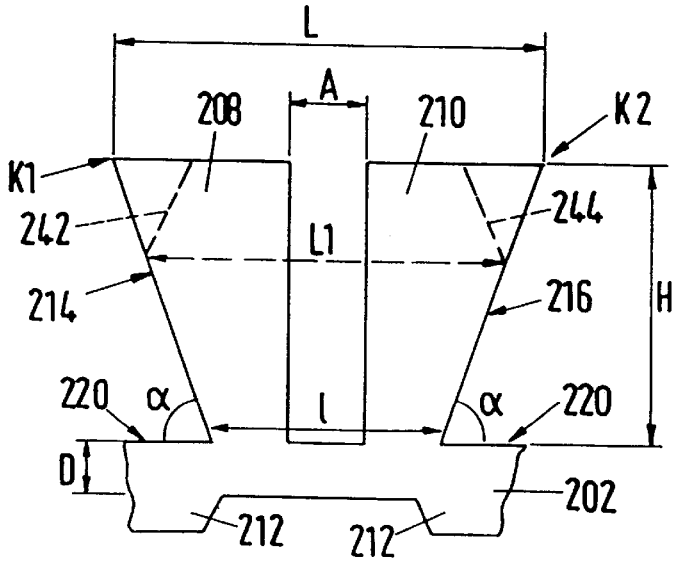
FIG. 5 illustrates a side view of a section of the belt according to FIG. 4 with a pair of connecting elements according to the invention.

Each connecting element 208, 210 consists of a transverse rib extending across the whole width B of the body 202, i.e. at right angles with respect to the longitudinal direction of the body. Each of the ribs 208, 210 is of a predetermined height H (e.g. ranging from 3 to 8 millimeters) relative to the body 202 and is tapered in its cross-section, the smaller "root" end of the tapered rib neighboring the body 202 and the wider head portion being arranged at the far end distance from the body 202. The ribs 208, 210 of a pair (e.g. of the pair 204 shown also in FIG. 5) mutually represent mirror images of each other and a slot A is provided between the ribs of the pair which is of constant width over the whole height of the ribs while the belt extends straight (FIG. 5). In the embodiment shown, this "slot" extends down to the root of the ribs.

Each of the ribs 208, 210 thus forms an inclined surface 214, 216, and the inclined surfaces of each pair are oriented in opposite directions. In the embodiments shown, each inclined surface of a pair (e.g. of the pair 204, FIG. 4) faces an inclined surface of the neighboring pair (e.g. of the pair 206). The inclined surface 214, 216 of a rib and the neighboring surface 220 of the body 202 from which the inclined surface 214, 216 extends enclose a predetermined acute angle $\alpha$ (e.g. ranging from 60 to 80 degrees) when the body 202 extends straight i.e. is flat. As will be explained in the following, each of the ribs 208, 210 has a rubber type elasticity at least in its root zone in such a manner that the ribs 208, 210 can be flexed towards each other by suitable forces as to reduce their mutual distance in the head portion zone. In this way, the slot A is punched in within the head portion zone. In addition, the ribs 208, 210 are able to flex relative to each other in response to bending of the body 202 within a path of movement of the body 202 in a card.

Figure 4:
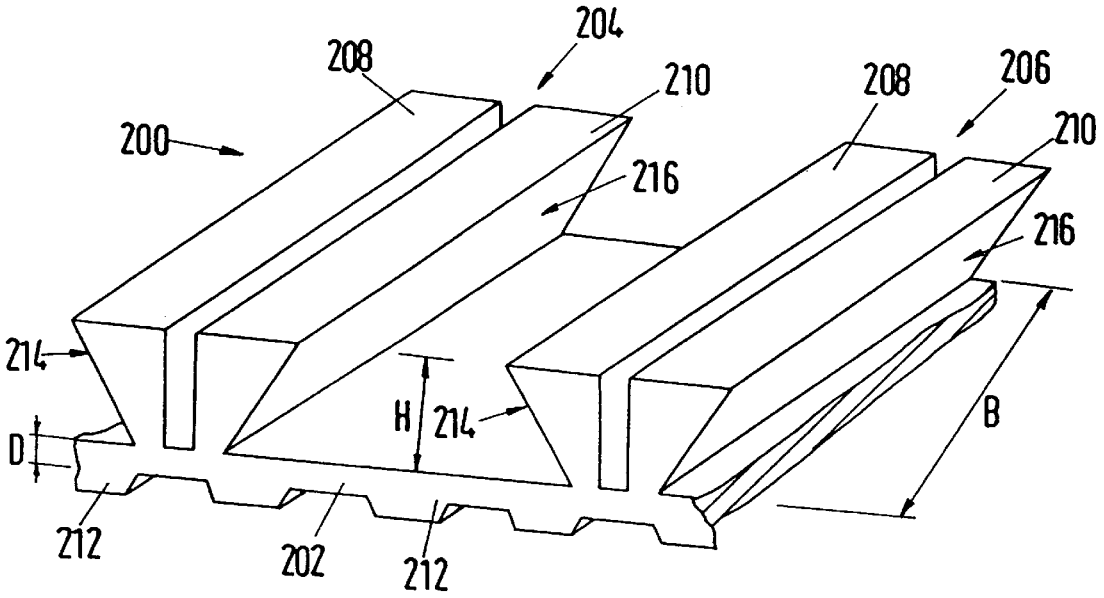
FIG. 4 illustrates an axonometric view of a drive belt according to the present invention.

A belt body according to FIGS. 4 or 5 is cut (or formed) to a predetermined length, the end portions of the body being interconnected to form an endless loop belt for application in a revolving flat arrangement 5, 6 according to FIG. 1. Thus, an endless path is determined for the revolving flats connected to the belt for operation. On the opposite side, the teeth 212 are arranged on the inside surface of the endless belt, and the pairs of ribs 204, 206 are arranged on the outside surface 220.

Let is be assumed first that the endless loop belt 200 moves in its own longitudinal direction in such a manner that each pair of ribs 204, 206 moves from the right hand side to the left hand side in the FIGS. 4 and 5. Preferably, each pair of ribs is designed symmetrically and thus it is not actually of importance in which direction the belt 200 moves. Assumption of a certain direction, however, facilitates the following descriptions. In its "ready state" (the body 202 being extended straight without forces acting on the ribs 208, 210), the distance in the longitudinal direction of the body 202 between the leading free edge K1 of the pair of ribs 204 (FIG. 5) and the trailing free edge K2 of the same pair of ribs 204 is of a predetermined value "L" which can range from 12 to 25 millimeters. The distance "L" in the following will be called the "span" of the pair of ribs. The corresponding distance "l" between the outer sides of the ribs 208, 210 at the root of the ribs 208, 210 in the same state is of a smaller predetermined value which can range from 9 to 22 millimeters.

Figure 6:
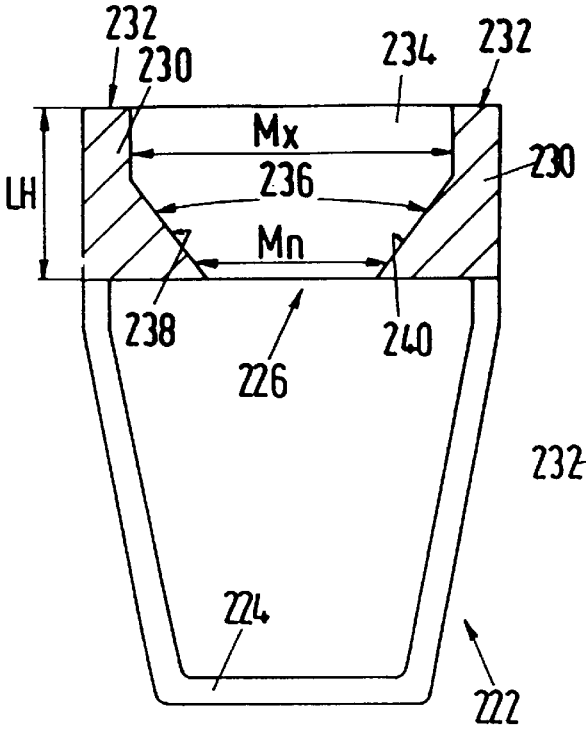
FIG. 6 illustrates a front view of a flat with an end head shown in a cross-sectional view and provided to co-operate with the elements according to FIG. 5 shown in a cross-section.
Figure 7:
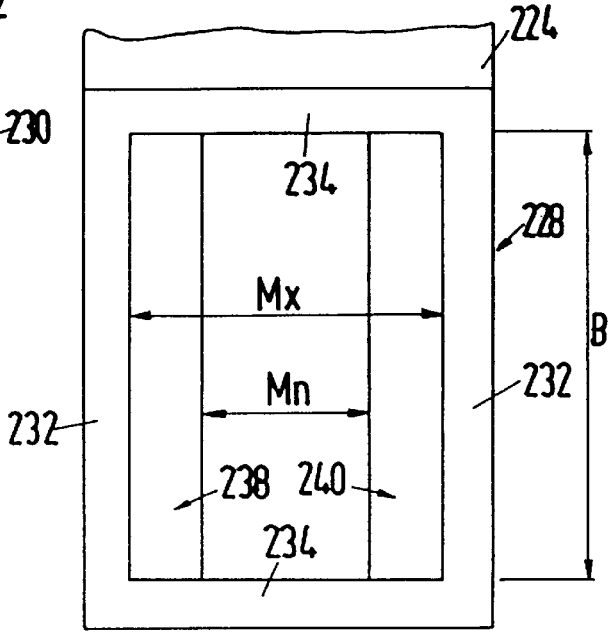
FIG. 7 illustrates a stop view of the end head according to FIG. 6.

Referring to FIG. 6, a flat 22 which is to cooperate with the belt 200 comprises a clothing support element in the form of a hollow profile 224 and two end heads 226 one only of which is visible in FIG. 6 and FIG. 7, respectively. Each end head 226 is provided with a connecting part (not shown, but compare the insert 41 in FIG. 3) which is pressed into the corresponding end portion of the profile 224 and held fixed therein. The preferred solution for fixing the end heads 226 in the profile 224 has been described in EP-A-627 507, but any other fixation arrangement which fulfills the requirements without complications could be applied also. The fixing of the end head 226 to the profile 224 thus will not be described in more detail here. In any case, a glide shoe/buckle element 228 (FIG. 7) of the corresponding end head 226 protrudes from each end of the profile 224.

The element 228 comprises two spaced apart parallel moldings 230 (FIG. 6) extending in the longitudinal direction of the flat 222. These moldings 230 each form a gliding surface 232 gliding on the gliding surface of the flexible arch while the flat is in its working position. The moldings 230 are formed in one piece with two traverses 234, which together with the moldings 230 form a rectangular opening of predetermined size for taking up the corresponding elements 208, 210 of the belt 200 in a mating snap-fit relation. The size of this opening in the longitudinal direction of the moldings 230 preferentially corresponds to the width B of the belt or the length of the ribs, respectively. (See FIGS. 7 and 14). In this manner, it is ensured that the belts of the revolving flat arrangement and the flats of the arrangement center each other mutually laterally.

Figure 8:
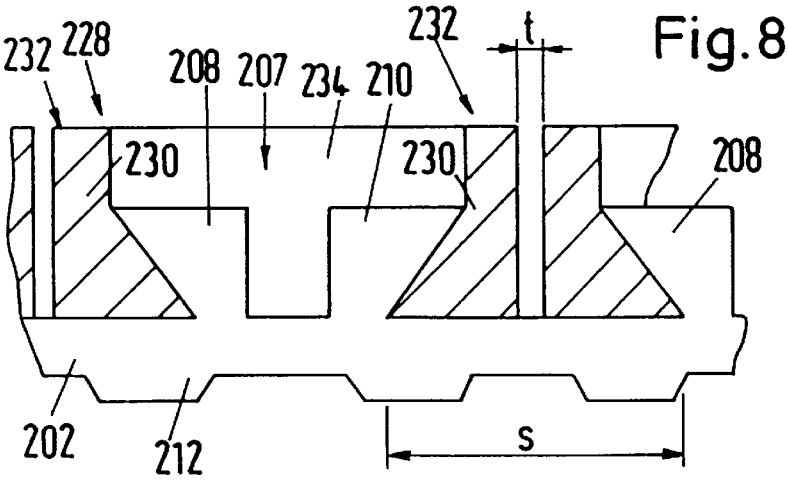
FIG. 8 illustrates a longitudinal section of a drive belt according to FIG. 5 with an end head according to FIG. 7 supported thereon.

The buckle or connecting function is achieved by two molding parts 236 (FIG. 6), the cross-sections of which show a taper in such a manner that they each present an inclined surface 238, 240 to mate with the inclined surface 214, 216 of a respective rib 208, 210. These inclined surfaces 238, 240 face each other and are separated by a predetermined minimum distance Mn (FIG. 7) which is considerably smaller than the span L (FIG. 5) and which is discussed in more detail in the following. The distances Mn and Mx, respectively, are called the "opening widths" of the clamping element.

in FIG. 8, a glide show/clamping element 228 is shoe connected to a pair of ribs 207 of the belt 200. The clamping element 228 has been snapped onto the pair of ribs 207 in such a manner that the inclined surfaces 238, 240 contact the inclined surfaces 214, 216 of the ribs. The height of each of the tapered portions of the moldings 230 approximately equals the height H of the ribs 208, 210, but the total height LH (FIG. 6) of each molding 230 is markedly higher, the gliding surfaces 232 (FIG. 8) thus being located high above the ribs 208, 210.

Each flat 222 is connected to a pair each of ribs in the same manner. The distance between neighboring flats 222 is predetermined and is to be kept as small as possible (see FIG. 8). The distance t of course is determined by the design of the moldings 230 and by the distance between neighboring pairs of ribs. This latter distance is also predetermined and at the roots of the ribs 208, 210 (neighboring the surface 220 of the body 202) has a value "S" (FIG. 8) ranging from 14 to 27 millimeters.

The snap-on connection according to FIG. 8 is to generate holding forces to such an extent that the following minimum requirements are fulfilled;

- the gliding surfaces 232 are seated firmly on the gliding surfaces on the flexible arch (resistance against tilting momentum;
- in the working position, and during the reverse path passage respectively, the drive forces are reliably transmitted from the belt 200 to the flat 222;
- at the reverse points the flats 22 are reliably held on the belt 200.

The requirement mentioned last substantially determines the extent of the holding force required whereas the other two requirements mainly influence the design details of the transmitting elements. The holding forces generated at one snap-on connection are to take care of at least half the weight of the flat (without any noticeable weakening of the connection), i.e. to exceed half the weight of the flat. The weight of a conventional flat ranges from 15 to 40 Newton (N). The holding forces connecting the flats to the belt are influenced on the one hand by the material (and particularly by its E-modulus) chosen for the belt 200 and, on the other hand, by the "geometry" lay-out of the ribs 208, 210 and of the moldings 230, in particular by:

the length of the rib (equal to the width of the belt in the embodiment shown);

the span of the pair of ribs in relation to the opening widths of the clamping element; and the value of the angle α enclosed by the inclined surfaces.

The selection of the angle α was made on the basis of calculations assuming the use of polyurethane as the structural material of the belt/ribs. Those calculations showed that:

1. The force needed to release the buckle element 228 is dependent upon (an approximately linear function of) the angle α. The selected range gives adequate, but not excessive, retaining forces considered relative to the weight of a flat.
2. The force needed to press the flat onto the rib pair is not dependent upon the angle α, but instead upon the 'angle of camber' at the outer end of each rib, i.e. the angle between the surface 242 or 244 in FIG. 5 and the vertical. For an angle of 45 degrees, a force of approximately 140 Newtons was calculated.

The width Mn of the opening of the clamp element preferentially is chosen about equal to the dimension "l" (FIG. 5) at the roots of the ribs 208, 210. The maximum width Mx of the clamp, however, preferentially is chosen smaller than the span L of the pair of ribs. In the installed state (FIG. 8), the distance A between the ribs at their head portions thus is reduced somewhat, i.e. the moldings 230 squeeze the ribs 208, 210 towards each other also in the fully snapped-on state. Much more force is required to squeeze the ribs 208, 210 towards each other during the snap-on process, as will be explained in the following with reference to the FIG. 10 through 12.

Figure 9:
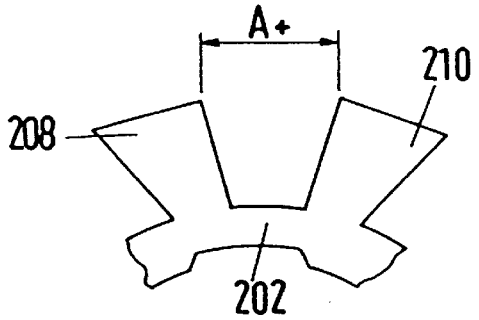
FIG. 9 illustrates a cross-section of a portion of the drive belt according to FIG. 5 bent in such a direction that the holding forces of the fixing elements are increased.

The holding forces furthermore are influenced also by the "degree of bending" of the belt body as explained with reference first to FIG. 9. The FIGS. 4, 5, and 8 all show (for the sake of simplicity) the belt body 200 extended straight. In reality, the path of the revolving flats at no location extends straight, and in the end zones comprises a path section each in which the belt body undergoes considerable bending deflection. The outside surface of the body 202 with its ribs 208, 210 is bent convex. The influence of this bending deflection is shown in the absence of a clamping element in FIG. 9, the ribs 208, 210 of each pair are spread apart particularly at their head portions in such a manner that the distance A (FIG. 5) is increased to A+ (FIG. 9). Such an increase is not effected in the presence of a clamping element, the moldings 230 being strong enough to withstand the "elastic forces" exerted by the pair of ribs. These elastic forces, however effect a noticeable increase in the holding forces while a pair of ribs holding a flat passes around a deflecting roll 6 (FIG. 1). This increase in holding forces at the deflecting rolls is a very advantageous effect eliminating the need for special guide mechanisms for loose flats in the deflecting zone.

The snap-on connection according to the present invention must, however, also permit the release of a flat (e.g. for maintenance of the flats or for checking on a flat) as well as the re-installation of a flat, if possible while the revolving flat arrangement is (still) moving. Installation of a flat is shown schematically in FIG. 10. First, one of the inclined surfaces (238 in FIG. 10) of the corresponding molding (230 in FIG. 10) is brought into contact with the inclined surface (214 in FIG. 10) of the corresponding rib (208 in FIG. 10). In this arrangement, the flat 222 is inclined in such a manner that the edge K1 on the other molding of the clamp can contact the head portion of the other rib 210 (state shown in FIG. 10). As pressure is applied to the still free molding, the rib 210 is deflected automatically in such a manner that the edge K1 can move past the edge K2 (FIG. 5) which effects the snap-on action of the clamp.

Figure 10:
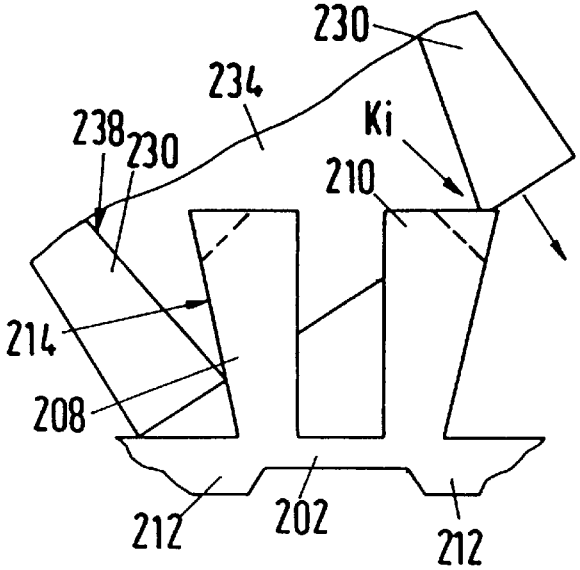
FIG. 10 illustrates a cross-sectional view of the other end head according to FIG. 7 being brought into contact with a portion of the belt according to FIG. 5.
Figure 11:
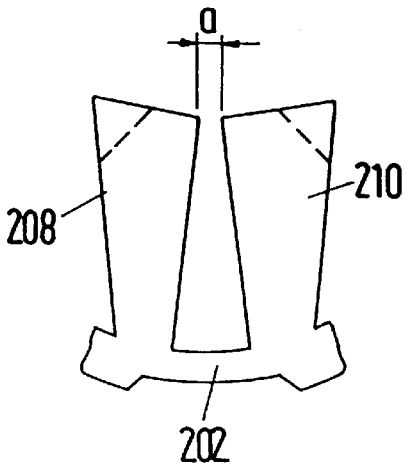
FIG. 11 illustrates a cross-sectional view of a portion of the belt according to FIG. 5 bent in such a direction that the distance between the fixing elements is reduced.

The simple shape of the rib head portion according to the FIGS. 4, 8 and 10 comprises a front surface extending in a single plane. If this shape is chosen, problems are to be expected during the "squeezing-in" process, and damages to the edges K1 and K2 are likely to occur. A partial solution of this problem is indicated in dashed lines in FIG. 5 where the front surface is bevelled, forming the guide surfaces 242, 244. Compared to the alternative solution indicated with solid lines, the span of the pair of ribs is reduced to L1 (FIG. 5). The transition zone between a guide surface and the corresponding inclined surface of the rib preferentially is rounded off rather than forming an edge. This design precaution simplifies the squeezing-on action according to FIG. 10. Installation as well as release of a flat under certain circumstances still could be somewhat tedious for the operator. This problem can be solved in an elegant way by reversing the effects according to FIG. 9. This solution is shown schematically in FIG. 11.

A bending deflection of the belt body 202 with its ribs 208, 210 on the concave surface of the belt brings the head portions closer together; the distance A (FIG. 5) being reduced to "a" (FIG. 11) or even being eliminated. The span L or L1 is reduced correspondingly which facilitates the squeezing-on action. A minimum bending effect of this type is generated if a flat 222 is placed onto a gliding surface of the flexible arc. The corresponding loosening of the holding forces, on the one hand, is minimal and, on the other hand, occurs at a location which for installing, and taking off respectively, flats are unsuitable. These latter functions rather should be effected while the flats move through their reverse path 245.

Figure 12:
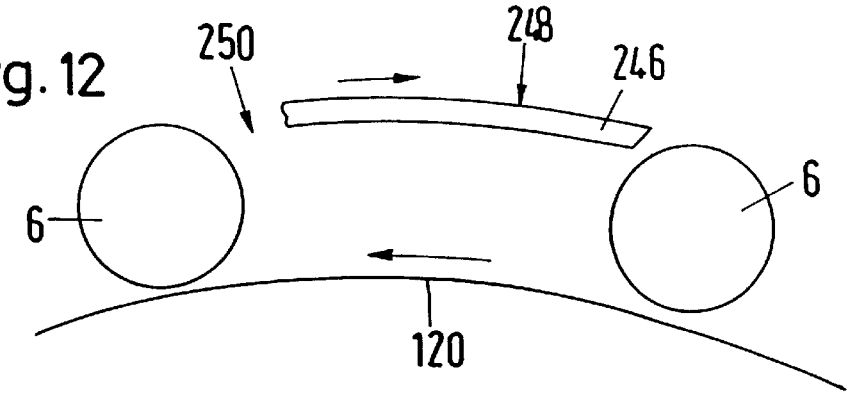
FIG. 12 illustrates a schematic side view of the guide elements for a drive belt of the revolving flat arrangement explaining the bending action shown in FIG. 11.

Referring to FIG. 12, where the belt (not shown) is moved in an endless path by two drive rolls 6 so as to have a first run faching moving with a card and a reverse run, the belt 202 is supported preferentially by a reverse path guide rail 248 which can present a slight bend even in the "wrong" direction. Thus, at least at one location (e.g. 250, FIG. 12), no guide mechanism should be provided for the belt 202 in such a manner that here an operator can effect the desired deflection of the belt (with or without the use of tools) all by himself. This "fitting station" preferentially is located in a zone where a belt portion in its movement along the revolving path leaves a deflecting roll and has not yet reached the reverse path guide rail. The fitting station can also be placed at another location along the reverse path, or even a plurality of fitting stations can be placed distributed along the path. In this arrangement, it is important that the fitting stations on both belts mutually correspond.

In a preferred embodiment (FIG. 8), the inclined surface 238, 240 of each molding 230 tightly hugs the inclined surface 214, 216 on the corresponding ribs 208, and 210 respectively. In this manner, it is achieved that the drive forces are transmitted from the belts onto the flats at a location in the closest possible vicinity of the belt body 202. Due to this arrangement, generating of a tilting momentum acting on the flats can be prevented or at least be minimized.

Figure 13:
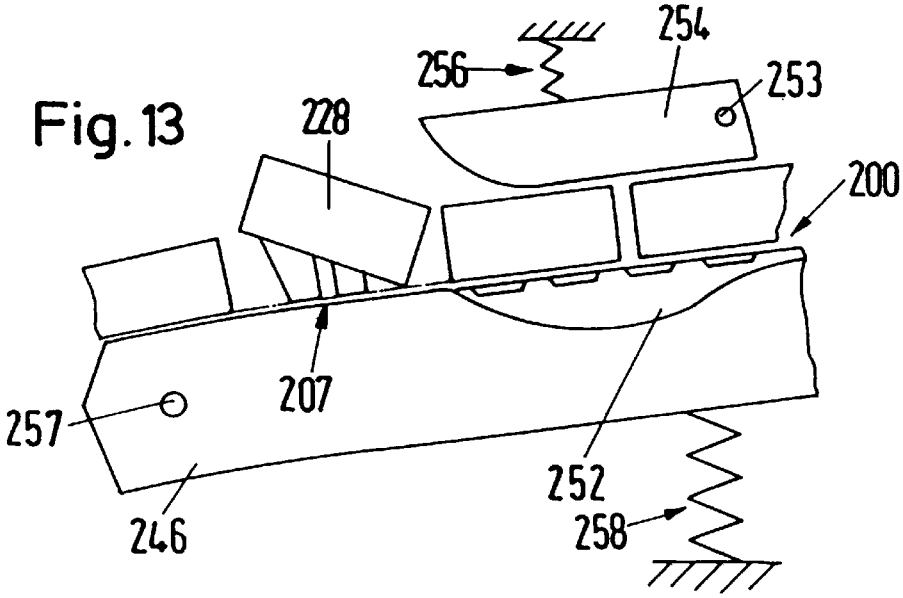
FIG. 13 illustrates a schematic side view of a modification of the arrangement according to FIG. 12.

In FIG. 13, a modification of the embodiment according to FIG. 12 is shown provided with a recess 252 in a reverse path guide rail 246 to which recess 252 a securing plate 254 is coordinated. If now, a pair of ribs (e.g. 207) with an incorrectly fitted flat approaches the plate 254 with its gliding head 228, the plate 254 presses the clamping element of the gliding head 228 down onto the pair of ribs 207. For this purpose, the plate 254 is rotatably supported on an axle 253 and is pretensioned by elastic means (e.g. a spring 256) towards the recess 252. The plate 254 maintains a predetermined distance from the reverse path guide rail during normal operation owing to a stop which is not shown. As a clamping element snaps on, the plate 265 is displaced upward (against the pre-tensioning action) by the reverse path guide rail 246.

The rail 246, in turn, is rotatably supported about an axle 257 and is pre-tensioned using elastic means 258 (e.g. a spring) in an upward direction for tensioning the belt 200. Thus, during normal operation the belt 200 is not guided into the recess 252, but the recess is bridged by the belt. A deflection into the recess is effected under the pressure exerted by the plate 254 if the latter is pressed upward as described before. The deflection exerts the effect described above with reference to FIG. 11.

The reverse path guide rails of course must each be provided (per machine side) with a device effecting mutual engagement of the elements of the snap-on connection. If the arrangement comprises a recess and a plate according to FIG. 13, the two devices must snap on the elements simultaneously.

Figure 14:
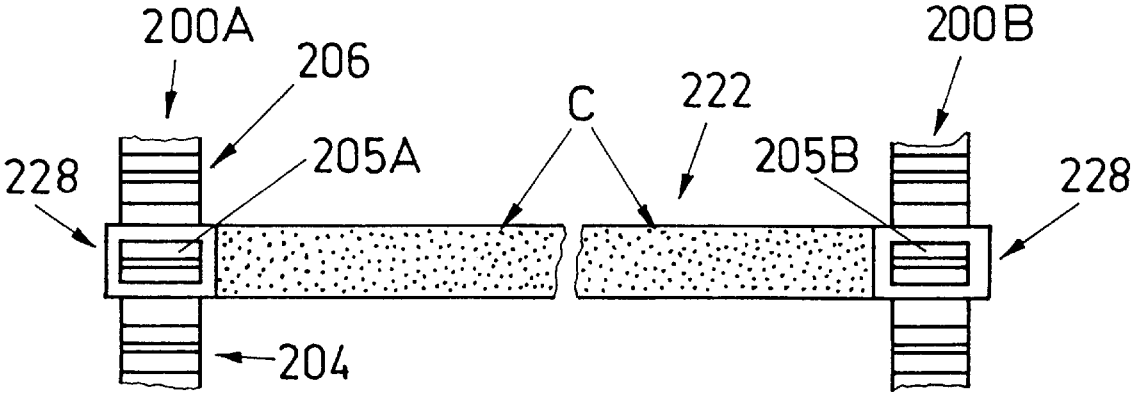
FIG. 14 illustrates a top view of a pair of connecting devices in accordance with the invention.

FIG. 14 shows the side portions of a flat 222 carried between two belts 200A, 200B respectively on opposite sides of a card (not shown in FIG. 14, compare FIG. 1). The central portion of the flat has been broken away. The flat 222 is viewed from above on its "return" run, i.e. the clothing C of the flat is facing upwardly for cleaning, so that the profile 31 (FIG. 3) is not visible but the buckles 228 of the end-heads can be seen. Each buckle is fastened to a rib-pair 205A, 205B on its respective belt. For the belt 200A, the adjacent rib pairs are indicated at 204 and 206 and are assumed not to be carrying flats—flat 222 could, for example, be the first flat mounted onto the belts during assembly or following maintenance work.

Figure 15:
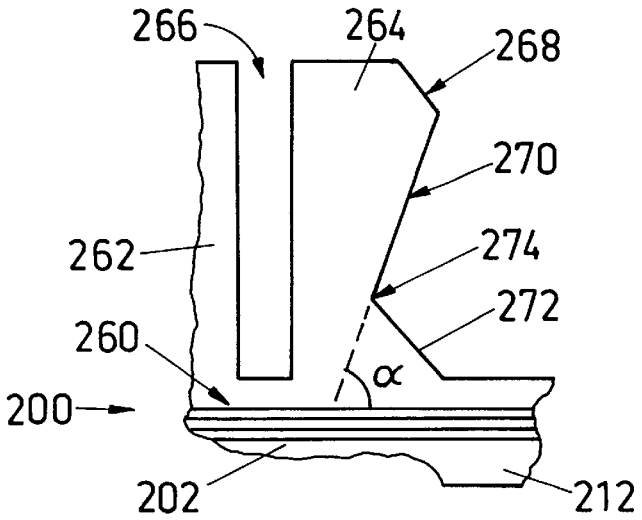
FIG. 15 illustrates a view of a modified rib as an alternative to the rib form shown in FIG. 5.

Referring to FIG. 15, wherein like reference characters indicate like parts as above, the body 202 of the belt 200 normally includes reinforcing elements 260 and pairs of ribs 262, 264 and only one rib 264 of which is shown in full. The rib 262 is formed as a mirror-image of the rib 264. The ribs 262, 264 of the pair are separated by a slot 266 which extends from the outer (free) ends of the ribs to the body 202 of the belt 200. The face of the rib 265 directed away from the rib 262 is formed with a lead-in surface 268 at the outer end of the rib, an inclined retaining surface 270 similar to the surface 216 in FIG. 4, and a sloping foot portion 272 which extends to the body 202. The sloped foot portion 272 joins the retaining surface 270 at a waist 274. As a flat is snap-fitted onto the belt, rib 264 bends at the waist 274, instead of at the root as in the case of the ribs 208, 210 (FIG. 4). The retaining surface 270 is, however, disposed at an acute angle $\alpha$ (between 60 and 80 degrees) to the length of the belt when the belt is straight, as shown in FIG. 15. The "length" of the belt is represented in this case by the reinforcing elements 260.

Figure 16:
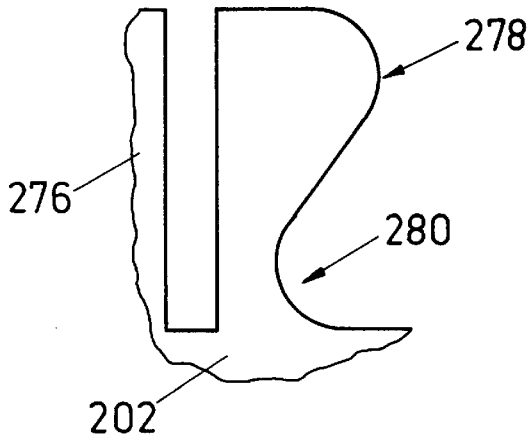
FIG. 16 illustrates a view of another alternative rib form with an inclined surface acting to retain a flat in accordance with the invention.

The embodiment shown in FIG. 15 has been illustrated with sharply defined edges where two surfaces meet. This is not actually a desirable form, for reasons already broadly outlined, and such edges are preferably rounded, especially where there is a risk of cutting of the rib by an edge on the buckle element, clamp or clasp member of the flat (not shown in FIG. 15). Rounding of the surfaces on the ribs could lead, for example, to a form of the kind illustrated at 276 in FIG. 16, where the retaining surface 278 is also rounded. However, it will be relatively difficult to obtain good cooperation between the buckle element and the ribs in an arrangement of the latter type, partly because it will be relatively difficult to form accurate mating surfaces on the buckle elements for the rounded faces of the ribs. In any event, the retaining surface of each rib preferably extends downwardly to the root 280 of the rib (where it adjoins the body 202 of the belt 200), for reasons which will be explained with reference to FIG. 17 and 18.

Figure 17:
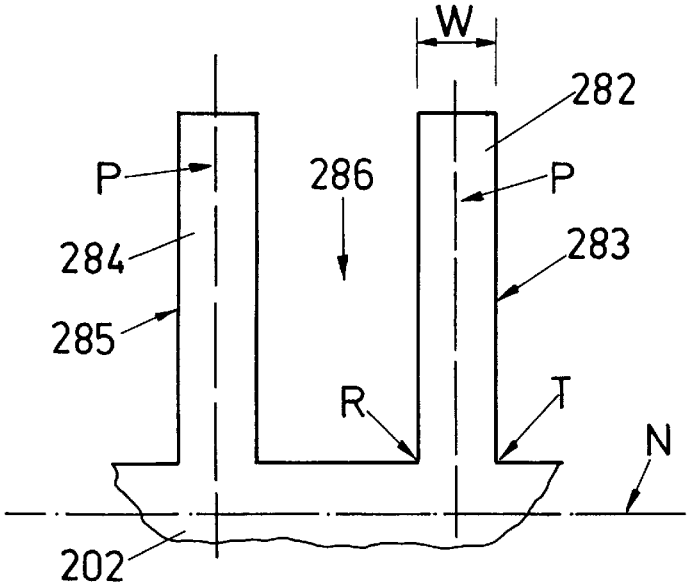
FIG. 17 illustrates a further rib construction to act on the retaining principle described with reference to FIG. 9 but without an inclined retaining surface.
Figure 19:
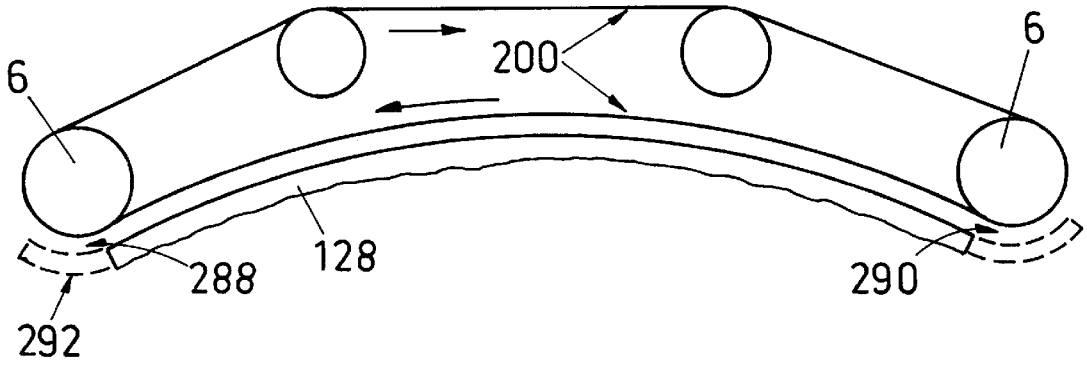
FIG. 19 illustrates a diagrammatic representation of the path of movement of a set of flats showing in particular in those regions in which special precautions are needed in use of a belt with ribs as shown in FIG. 18.

FIG. 17 shows a pair of ribs 282, 284 each of which has a simple rectangular section. The ribs of a pair are separated by a slot 286. Each rib 282, 284 is integral with or firmly secured to the body 202 of the belt and the pair of ribs is received by a buckle, clasp or clamp similar to those already described but with side faces adapted to engage rib faces 283, 285. Each rib can be made sufficiently stiff to transfer drive forces to its flat in accordance with the principles disclosed in U.S. Pat. No. 4,955,111, so that the flat is moved around its intended path of movement (see FIG. 19). The direction of movement of the flats in FIG. 19 is indicated by arrows, but this direction is assumed merely for purposes of illustration and description; the flat could equally well move in the opposite direction. As regards retaining of the flat relative to the belts, no problems arise while the flats are moving along the flexible bends 120 (compare FIG. 2) or along the opposite return run of the belt.

Figure 18:
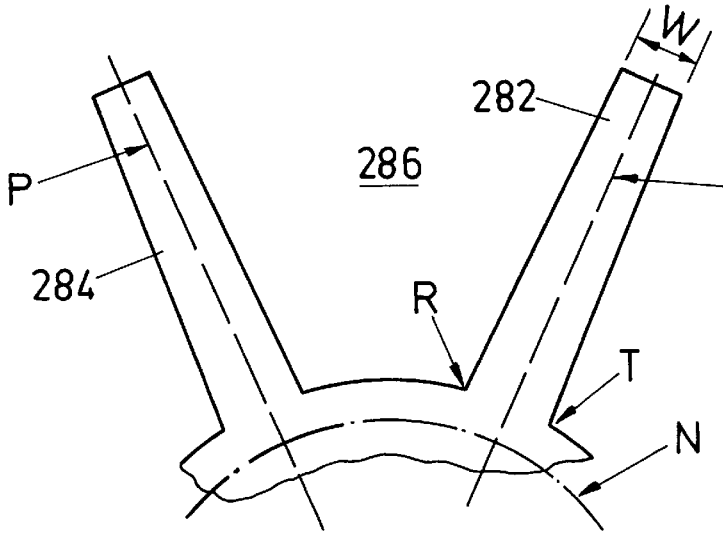
FIG. 18 illustrates a view similar to FIG. 9 showing the pair of ribs illustrates in FIG. 17 during movement about a guide roller.

No problems arise either while the belt 200 is flexed as indicated in FIG. 18 in a sense tending to spread the ribs 282, 284, i.e. to widen the slot 286 at its outer end. Such spreading is shown in FIG. 18 but is not in fact possible when the rib pair is properly located in its buckle, because the ribs engage the side faces of the buckle continuously. The tendency to spread the ribs generates lateral forces on the walls of the buckle, however, and the resulting friction is adequate to retain the flat so long as the belt is adequately flexed in the appropriate sense. Problems arise only the transition zones 288, 290 (FIG. 19) where the belt flexes from one curvature configuration (determined by the flexible bends 128) to another (determined by the guide rollers 6, compare FIG. 1) so that friction forces on the flat cannot be generated while at the same time the weight of the flat is tending to pull it off the belt. In order to deal with such problems in zone 288, it is possible to provide a short extension piece 292 (shown in dotted lines in FIG. 19) to continue guidance of each flat as it moves off the flexible bends 128 until the belt has been flexed to the curvature of the guide rolls 6 so that the flat is held firmly by friction forces generated by its respective pair of ribs 282, 284. A similar extension piece can be provided in the zone 290 to perform a corresponding function as the friction forces generated by a rib pair are reduced prior to laying of the flat on the flexible bends 128. The arrangement has the advantage that virtually no retaining forces are generated by the ribs 282, 284 on the flats while they are moving along the return run (opposite the flexible bends 128) so that it is very easy to remove and replace the flats on the run.

The simple rib form shown in FIGS. 17 and 18 is convenient for purposes of a more detailed explanation of the retaining effect. Assume that each rib has a central longitudinal plane P ("plane of symmetry") and that the body 202 of the belt has a neutral plane N, i.e. a plane in which the material of the belt remains substantially undistorted as the belt is flexed by bending it about an axis at right angles to its length but parallel to its width. In the configuration shown in FIG. 17 (belt 200 stretched out straight), the plane P of each rib stands at right angles to the neutral plane N of the belt. In the configuration shown in FIG. 18, the axis of curvature of the belt is not shown but lies on the side of the belt remote from the ribs 282, 284. The material of the belt 202 above the neutral plane N in FIG. 18 is therefore stretched (relative to FIG. 17) and the material of the belt below the neutral plane N is compressed.

There, the material lying in the plane R—T in FIG. 17 (at the "root" of the rib 282, where the rib 282 adjoins the body 202 of the belt) is stretched into an arc R—T in FIG. 18 with a radius of curvature given by the position of the bending axis (not shown). As the belt passes around a guide roller 6, the bending axis is the axis of rotation of the guide roller.

Assume for purposes of explanation that the rib pair 282, 284 is not carrying a flat as the pair passes around the guide roller 6, so that the ribs of the pair are free to diverge as shown in FIG. 18. Although this condition is not foreseen in practice, the results of a corresponding analysis are relevant because the retaining forces are generated by restraining elements of the buckle (clasp or clamp) preventing the divergence which should arise from bending of the belt. Accordingly, for a given choice of material of the belt, the retaining forces which will be exerted on a buckle (clasp or clamp) of a flat are dependent upon the degree of divergence that would have arisen if the rest-raining elements of the buckle were not present. Consider therefore the configuration shown in FIG. 1. The plane of symmetry P of the rib 282 will intersect the bending axis. Beyond (radially outwards from) the arc R—T, there are practically no forces acting within the material of the rib 282 causing the rib 282 to stretch in the same way as the root section of the rib, so that the width W of the outer rib end remains practically unchanged when compared with FIG. 17. Each rib 282, 284 therefore projects substantially radially from the belt 200.

It is important for the achievement of this effect that the slot 286 extends from the outer ends of the ribs to the body 202 of the belt. Insofar as the slot 286 is "filled" at its inner end, i.e. material is left in place joining the ribs together, restraining forces are generated which tend to reduce spreading of the ribs during bending of the belt and therefore to reduce the retaining forces generated at the guide rollers 6 in the arrangement of FIG. 19. It is therefore not necessary to form the ribs integrally with the body 202 of the belt; the ribs could be formed separately and then fastened to the belt in any suitable manner. However, it will normally be preferable to form the body of the belt with the ribs (and the teeth 212) in one piece. If the ribs are formed separately from the body of the belt, they do not have to be made of an elastically deformable material, although the use of such a material is preferred.

It should also be apparent from FIG. 18 that the same effect can be achieved by the relative approach of the ribs of a pair as the belt passes around a guide roller 6, because as the ribs 282, 284 of a pair are spread, each rib of the pair approaches the respective adjacent rib (not shown) of the neighboring rib pair. In a modified arrangement, therefore, each rib can be paired with an adjacent rib so that the outer ends of a rib pair tend to approach each other as they pass around a guide roller, and in so doing they exert retaining forces on an element of a flat located between them.

In the preferred solution, each rib is provided with an "undercut" profile as shown in FIGS. 4, 5, 15 and 16 (i.e. the rib faces which engage the flat have a lesser spacing at a position close to the body of the belt then they have at a position further from the belt), so that a snap-fit connection is made between the ribs and the ends of a flat. This is possible even if the ribs themselves are not elastically deformable. As previously indicated, it is not essential that each rib should extend across the whole width of the belt; an "pair" of ribs could therefore comprise a set of elements at least two of which tend to diverge or to approach each other as the body of the belt is subjected to bending.

The scope of the present invention is not limited to the embodiments shown. It is possible also, e.g. to directly oppose the ribs and to provide the flats with a "snap-on lock" provided with two inclined surfaces which squeezes the ribs apart during installation of the flat. An arrangement of this type, however, does not present the same resistance against torsion momentum which can be generated by the clothing during the carding action and which tends to tilt the flat about its own longitudinal axis.

Detectors can be provided for checking the engaged flats and their connections and generating an alarm signal if any defects are detected.

Each rib member can be formed by a plurality of part rib members, each part rib member extending only over part of the belt width.

The embodiment according to the present invention additionally provides the following advantageously effects:

1) The pre-tensioned connection of each flat to the belt dampens transmission of minor elongation deviations from the belts to the flat arrangement.
2) The positive connection between each flat to the belt evens out the longitudinal forces in the belt, which results in a dampening effect on vibrations in the longitudinal direction.
3) Dampening of impacts affecting the flats during the carding action.
4) The spring characteristics of an elastomer material generate increasing resistance against deforming forces as these forces increases.

What is claimed is:

1. A drive belt for mounting a plurality of flats in a revolving flat card comprising a body;

a plurality of teeth integral with and disposed on one side of said body; and a plurality of pairs of connecting elements integral with and disposed on an opposite side of said body from said teeth, each connecting element being of predetermined height relative to said body and having an inclined surface on one side extending from said body and forming a predetermined acute angle with said body, said inclined surfaces of said connecting elements of each pair of connecting elements being directed in opposite directions longitudinally of said body, each said connecting element being spaced from the other connecting element of each pair of connecting elements to permit flexing of said pair of connecting elements towards each other to effect a snap-on connection within an opening of a clamp element of a flat.

2. A drive belt as set forth in claim 1 wherein said angle is in a range of from 60° to 80°.

3. A drive belt as set forth in claim 1 wherein said connecting elements of each pair of connecting elements are spaced apart to define a slot of a width of at least 1 millimeter.

4. A drive belt as set forth in claim 1 wherein each said inclined surface extends to a free edge of a respective connecting element.

5. A drive belt as set forth in claim 1 wherein said height of each connecting element is in a range of from 5 to 8 millimeters.

6. A drive belt as set forth in claim 1 wherein each connecting element is of a width equal to the width of said body and is in a range of from 20 to 30 millimeters.

7. A drive belt as set forth in claim 1 wherein said connecting elements of each said pair of connecting elements are symmetrical to each other.

8. A drive belt as set forth in claim 1 wherein each pair of connecting elements is spaced from an adjacent pair of connecting elements over a minimum distance of 14 millimeters at said body.

9. A drive belt as set forth in claim 1 wherein said body is an endless body.

10. A drive belt as set forth in claim 1 wherein said connecting elements of each said pair of connecting elements define a slot therebetween whereby upon bending of said body said connecting elements of each respective pair of connecting elements deflect away from each other to increase the width of said slot.

11. A drive belt as set forth in claim 10 wherein said slot extends from said belt and is of equal height to said pair of connecting elements.

12. A drive belt as set forth in claim 11 wherein each said connecting element is of a length equal to the width (B) of said body.

13. A drive belt as set forth in claim 1 wherein said connecting elements of each said pair of connecting elements define a slot therebetween whereby upon bending of said body said connecting elements of each respective pair of connecting elements deflect towards each other to decrease the width of said slot.

14. A drive belt for mounting a plurality of flats in a revolving flat card comprising a body;

a plurality of teeth integral with and disposed on one side of said body; and a plurality of pairs of connecting elements integral with and disposed on an opposite side of said body from said teeth, each connecting element being of predetermined height relative to said body and having an inclined surface on one side forming a predetermined acute angle with said body, said inclined surfaces of said connecting elements of each pair of connecting elements being directed in opposite directions longitudinally of said body, each said connecting element being spaced from the other connecting element of each pair of connecting elements to define a slot therebetween extending to said body to permit flexing of said pair of connecting elements towards each other to effect a snap-on connection within an opening of a clamp element of a flat.

15. A drive belt as set forth in claim 14 wherein said angle is in a range of from 60° to 80°.

16. A drive belt as set forth in claim 14 wherein each said inclined surface extends between a free edge of a respective connecting element and an intermediate point of said respective connecting element.

17. A drive belt as set forth in claim 16 wherein each connecting element has a second inclined surface extending from said intermediate point to said body to form an obtuse angle with said body.

18. In a revolving flat card, the combination of at least one drive belt having an endless body and a plurality of pairs of spaced apart connecting members integral with and disposed on one side of said body, each connecting member having an inclined surface on one side extending from said body and forming an acute angle with said body; and at least one flat removably mounted on said drive belt, said flat having a head at at least one end thereof including an element defining an aperture therein receiving a respective pair of said connecting elements therein in mating relation.

19. The combination as set forth in claim 18 wherein said head of said flat includes a pair of spaced apart parallel moldings, each molding having an inclined surface mating with said inclined surface of a respective connecting element to form a snap-fit connection of said flat on said belt.

20. The combination as set forth in claim 19 wherein said snap-fit connection generates a holding force exceeding one-half of the weight of said flat.

21. The combination as set forth in claim 20 wherein said weight of said flat is in a range of from 15 Newtons to 40 Newtons.

22. The combination as set forth in claim 19 wherein each head has a pair of parallel traverses connected to and between said moldings to define said aperture.

23. The combination as set forth in claim 18 wherein said flat includes a clothing support element extending perpendicularly of said belt and said head of said flat includes an insert secured to said support element.

24. The combination as set forth in claim 23 wherein said clothing support element is a hollow profile.

25. The combination as set forth in claim 18 which further comprises a guide rail for guiding said flats longitudinally thereof during revolving of said belt in an endless path.

26. The combination as set forth in claim 25 which further comprises a fitting station adjacent one end of said guide rail defining a space of a size sufficient to pass said flat therethrough into or from engagement with said belt while deflecting said belt in a direction away from said guide rail.

27. The combination as set forth in claim 26 which further comprises a pair of rolls for moving said belt in an endless path with a first run facing a card and a reverse run, and wherein said fitting station is located in said reverse run.

28. The combination as set forth in claim 25 wherein said guide rail has a recess therein to permit deflection of said belt thereat and which further comprises means on an opposite side of said belt from said recess in said rail for biasing said flat into engagement with said connecting elements of said belt thereat.

29. A drive belt for mounting a plurality of flats in a revolving flat card comprising an elongated elastically deformable body;

a plurality of teeth disposed on one side of said body; and a plurality of pairs of connecting elements disposed on an opposite side of said body from said teeth, each connecting element being of predetermined height relative to said body, each said connecting element being spaced from the other connecting element of each pair of connecting elements to define a slot therebetween extending to said body to permit flexing of said pair of connecting elements towards each other to effect a connection within an opening of a clamp element of a flat and to permit flexing of said pair of connecting elements relative to each other in response to bending of said body within a path of movement of said body in a card without a clamp element of a flat thereon.

30. A drive belt as set forth in claim 29 wherein at least one of said connecting elements of each pair of connecting elements has an undercut profile to effect a snap-fit connection with a clamp element of a flat.

31. In a revolving flat card, the combination of at least one drive belt having an endless elastically deformable body and a plurality of pairs of spaced apart connecting members disposed on one side of said body, each connecting member element extending from said body and being spaced from the other of said connecting elements of said pair of connecting elements of said body; and at least one flat removably mounted on said drive belt, said flat having a head at at least one end thereof including an element defining a buckle aperture therein receiving a respective pair of said connecting elements therein in mating relation.

32. The combination as set forth in claim 31 wherein at least one of said connecting elements of a respective pair has an undercut profile and said flat has a surface mating with said profile to form a snap-fit connection of said flat on said belt.

33. The combination as set forth in claim 31 which further comprises at least one guide roller for guiding said drive belt thereon in an arcuate path to effect a concave bending of said belt whereby said connecting elements of each pair of connecting elements are biased against said head received thereon during travel of said belt about said guide roller.

34. The combination as set forth in claim 31 wherein each said pair of connecting elements have a predetermined span (L) and said aperture of said buckle element of said flat has a maximum width ($M_x$) smaller than said span whereby said pair of connecting elements are compressed towards each other within said buckle element.

35. The combination as set forth in claim 31 wherein each said pair of connecting elements is of a length equal to the width of said body and equal to the width of said aperture of said buckle element of said flat to effect a mutual centering of said flat on said belt.

36. The combination as set forth in claim 31 wherein said buckle element has a pair of gliding surfaces opposite said belt for gliding on a surface of a card frame.

37. The combination as set forth in claim 31 wherein each connecting element has an inclined surface extending from said body and forming an acute angle with said body and wherein said buckle element has a surface engaging said body and an inclined surface mating with said inclined surface of said connecting element to avoid tilting of said flat relative to said belt.

38. A drive belt for mounting a plurality of flats in a revolving flat card comprising a body;

a plurality of teeth integral with and extending from one side of said body; and a plurality of pairs of connecting elements on an opposite side of said body from said teeth; each connecting element being of a predetermined height (H) relative to said body and having an inclined surface on one side extending from said body and forming an acute angle with said body in an range of from 60° to 80°.

39. A drive belt as set forth in claim 38 wherein said body has a thickness (D) of from 1 to 3 millimeters and each connecting element is of a height (H) of from 3 to 8 millimeters.

40. A drive belt as set forth in claim 38 wherein each pair of connecting elements extends over a root length (l) at said body of from 9 to 22 millimeters and defines a slot therebetween having a width (A) of at least 1 millimeter.

41. A drive belt as set forth in claim 40 wherein each connecting element has a beveled guide surface extending from said inclined surface to an end of said connecting element and in a direction towards the other of said connecting elements of said pair of connecting elements whereby said pair of connecting elements have a maximum span (L1) below said end of each connecting element.

42. In combination, a drive belt having a body, a plurality of teeth integral with and extending from one side of said body and a plurality of pairs of connecting elements on an opposite side of said body from said teeth, each connecting element having an inclined surface on one side extending from said body and each said pair of connecting elements extending over a root length (l) at said body of from 9 to 22 millimeters and having a predetermined span (L) greater than said root length; and at least one flat removably mounted on said belt, each flat having a buckle element defining an opening receiving a respective pair of said connecting elements of aid belt, said opening of said buckle element having a minimum width ($M_N$) at a mouth thereof less than said span (L), said buckle element having surfaces mating with and engaging under said inclined surfaces of said pair of connecting elements.

43. The combination as set forth in claim 42 wherein said span (L) of said connecting elements is disposed in spaced relation to the ends of said connecting elements.

* * * * *

UNITED STATES PATENT AND TRADEMARK OFFICE

CERTIFICATE OF CORRECTION

PATENT NO. : 5,956,811

DATED : September 28, 1999

INVENTOR(S) : PAUL CAHANNES and OLIVER WUEST

It is certified that error appears in the above-identified patent and that said Letters Patent is hereby corrected as shown below:

Column 1, line 7, change "for"(second occurrence) to --from--.

Columm 2, line 18, change "a sa" to -as a-

Line 51, change "stop" to -top-

Column 3, line 14, change "illustrates" to -illustrated-

Column 4, line 48, change "case" to -cast-

Column 5, line 23, change "punched" to -pinched-

Column 6, line 29, change "show" to -shoe-; change "shoe" to -shown-

Signed and Sealed this

Twenty-fifth Day of April, 2000

*Attest:*

Q. TODD DICKINSON

*Attesting Officer*

*Director of Patents and Trademarks*